United States Patent [19]

Bida et al.

[11] Patent Number: 4,752,432

[45] Date of Patent: Jun. 21, 1988

[54] DEVICE AND PROCESS FOR THE PRODUCTION OF NITROGEN-13 AMMONIUM ION FROM CARBON-13/FLUID SLURRY TARGET

[75] Inventors: Gerald Bida; Derrick Schmidt, both of Los Angeles County; George O. Hendry, Napa County; Bruce W. Wieland, Contra Costa County, all of Calif.

[73] Assignee: Computer Technology and Imaging, Inc., Knoxville, Tenn.

[21] Appl. No.: 875,635

[22] Filed: Jun. 18, 1986

[51] Int. Cl.[4] ..... G21G 1/10

[52] U.S. Cl. ..... 376/195; 376/201; 376/202

[58] Field of Search ..... 376/194, 195, 199, 201, 376/202

[56] References Cited

U.S. PATENT DOCUMENTS

| | | | |
|---|---|---|---|
| 2,504,585 | 4/1950 | Reid | 376/199 |
| 2,868,987 | 1/1959 | Salsig, Jr. et al. | 376/194 |
| 3,151,243 | 9/1964 | Mott | 376/194 |
| 4,444,717 | 4/1984 | de Breze | 376/194 |

OTHER PUBLICATIONS

Radiochimica Acta, vol. 6, Aug. 1966, pp. 32–39, Ache et al.

Int. J. Appl. Radiat. Isot., vol. 35, No. 8, pp. 771–777, 1984, Suzuki et al.

Int. J. Appl. Radiat. Isot., vol. 33, pp. 525–532, 1982, Brinkman.

Int. J. Appl. Radiat. Isot., vol. 34, No. 6, pp. 897–900.

*Primary Examiner*—Harvey E. Behrend

*Attorney, Agent, or Firm*—Pitts and Brittian

[57] ABSTRACT

A system and process for the production of nitrogen-13 atoms from carbon-13/fluid slurry is provided. The system (10) includes a device (14) for producing a proton beam (15) which travels along a preselected path and strikes a target in slurry. This target is positioned in the path of the proton beam (15) such that subjection of the target to such beam produces nitrogen-13 atoms in a predetermined form. The nitrogen-13 atoms are conducted from the target area and carried to a purification device for collecting a purified product containing such atoms. The cooling system serves to dissipate heat generated during the production of such nitrogen-13 atoms.

13 Claims, 2 Drawing Sheets

DEVICE AND PROCESS FOR THE PRODUCTION OF NITROGEN-13 AMMONIUM ION FROM CARBON-13/FLUID SLURRY TARGET

DESCRIPTION

1. Technical Field

This invention relates to a device and process for the direct production of nitrogen-13 ammonium ion in an aqueous or other fluid solution from a carbon-13 fluid slurry target.

2. Background Art

Nitrogen-13 is commonly used in scanning operations where it is introduced into the body and monitored by state-of-the-art techiques. It is desirable to produce nitrogen-13 by a relatively simple process. Known prior art methods teach the use of natural water in a batch or recirculating mode to produce predominantly nitrogen-13 oxides. These oxides must be chemically reduced in a basic solution to ammonia which is then distilled and collected. Prior devices and methods employing this approach produce added complexity, chemical losses, and processing time with concomitant, crucial radioactive decay loss. In addition, the p,$\alpha$ nuclear reaction on natural water has a much lower probability of occurrence for low energy protons than the p,n reaction on carbon-13 in the target original employed in the present invention.

Accordingly, it is an object of the present invention to provide a slurry target capable of generating a high yield of nitrogen-13, and the direct production of the desired chemical form in a simple continuous flow collection which precludes complex chemical processing and radioactive decay losses.

It is another object of the invention, with the utilization of 10.2 MeV protons entering the target at a beam current of 20 $\mu$A, to produce about 175 mCi of nitrogen-13 ammonium ion in a time period of 10 minutes. In the prior art, a typical larger cyclotron (16 MeV) produces nitrogen-13 using 20 $\mu$A of protons on natural water; and after chemical reduction, about 175 mCi of ammonium ion is available in a time period of about 25 minutes after the initiation of bombardment. Therefore, the slurry target of the present invention produces in one embodiment about the same activity in about half the time using two-thirds of the proton energy.

It is a further advantage of the present invention that the enriched carbon-13 inventory employed as a constitutent part of the fluid slurry target is not expended since it remains fixed in the target for subsequent production runs.

SUMMARY OF THE INVENTION

In accordance with the illustrated embodiment of the invention, a system and a process is provided for the utilization of an original carbon-13/fluid slurry target for the direct production of nitrogen-13 ammonium ion in aqueous or other fluid solution. The target material employed in the preferred embodiment of the present invention, carbon-13/fluid slurry, is captured and maintained at high pressure and washed through by natural water entering and leaving through porous metal frits. Radioactive nitrogen-13 is produced concurrently in the carbon-13 powder by the p,n reaction and in the natural oxygen-16 water by the p,$\alpha$ reaction. A fraction of the radioactive nitrogen-13 atoms produced in the carbon powder recoil and diffuse into the water. The chemical form of the nitrogen-13 removed from the target by the one-pass water flow is predominantly ammonium ion in aqueous solution. The radioactive water effluent is transported through a purification column to remove unwanted nitrogen oxides, and the resultant purified nitrogen-13 ammonium ion product is collected for use.

DESCRIPTION OF THE PREFERRED EMBODIMENT

Figure 1:
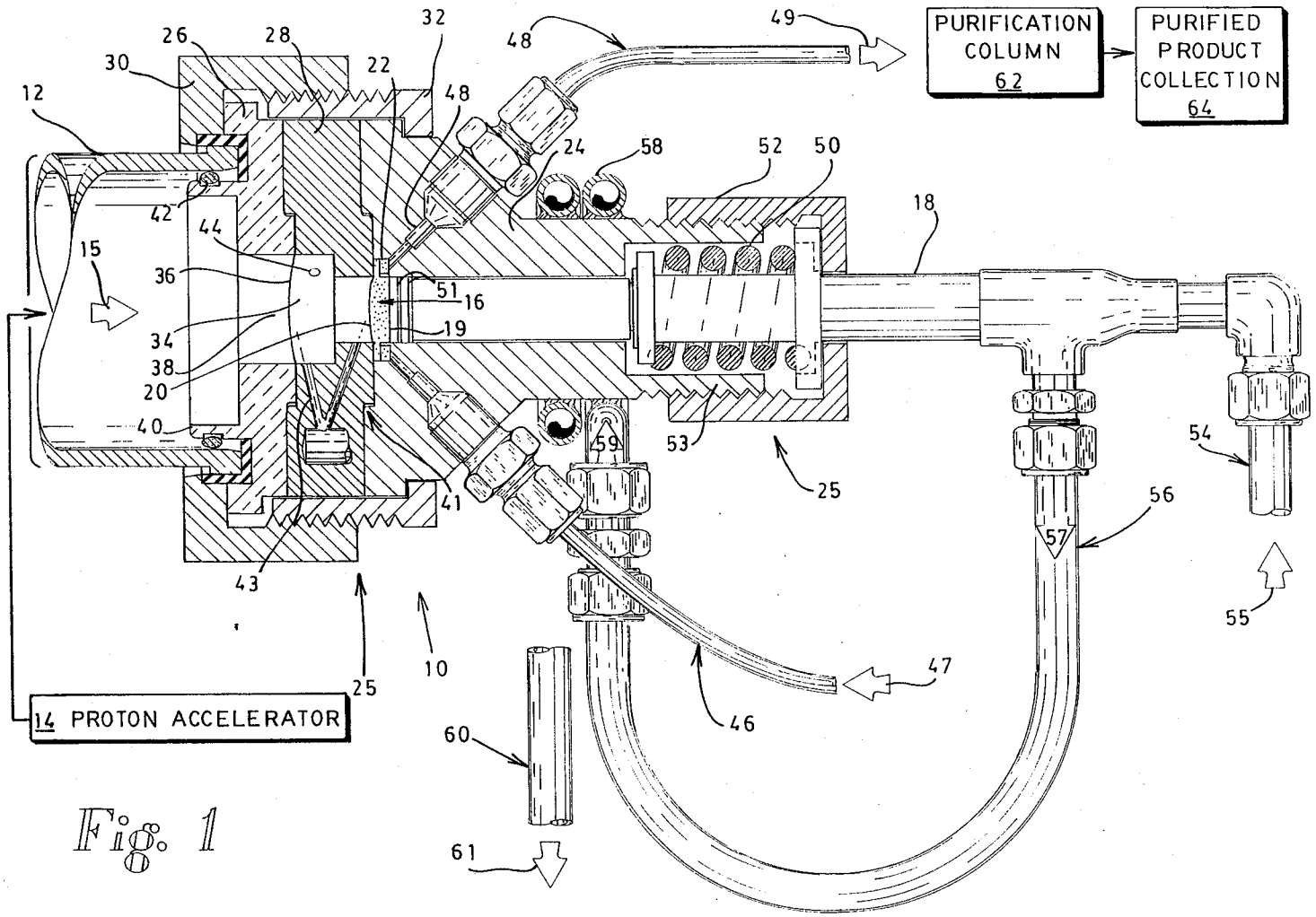
FIG. 1 is a sectional view of a target assembly device with a proton accelerator (cyclotron) indicated by block diagram.

Referring now to the figures, a system for the utilization of a fluid slurry target for the direct production of nitrogen-13 ammonium ion in aqueous or other fluid solution is generally indicated at 10 in FIG. 1.

The system 10 includes means for producing a proton beam which travels along a preselected path. To this end, an evacuated accelerator beam tube 12 is connected from a proton accelerator (cyclotron) indicated by box diagram 14. This cyclotron technology is well known in the prior art and can be provided in the form of many types of apparatus for giving high energy to particles, usually protons, deuterons and helium ions. In the preferred embodiment of the invention, the cyclotron 14 provides a beam 15 collimated to a 10 mm diameter of 10.2 MeV protons. However, it will be understood by those skilled in the art that differing diameters and intensities of proton beams can be provided by different means.

A target material 16 is aligned with the spring loaded piston 18 and the beam tube 12. The target material 16 is contained and held in position by the target window 20, the frits 22, the spring loaded piston 18, and the target body 24. In the preferred embodiment, the target material 16, carbon-13/fluid slurry, consists of carbon powder which is highly enriched in the stable isotope carbon-13, and natural water. It will be understood by those skilled in the art that other target materials and nuclear reactions (for example $^{12}C(d,n)^{13}N$) can be utilized, as the target material 16. Also, a multi-phase target material such as one having two solids and a liquid can be used. In the preferred embodiment, the target window 20 will be constructed of titanium, but it is understood that other metals, alloys, or synthetic materials can be employed in construction of the target window 20. In addition, the frits 22 of the preferred embodiment of the invention are constructed of porous stainless steel. The frits 22 are very fine filters that allow water to pass through, but do not allow passage of carbon powder constituting the target material 16. Consequently, it will be understood that any number of materials could be used in the construction of the frits 22.

The alignment and attachment assembly shown generally at 25 in FIG. 1 is composed of the nose piece 26, the window cooling spacer 28, the target body 24, the compression nut 30, and the coupling union 32.

The window cooling spacer 28 is seated against the target body 24 and has a centrally disposed window cooling space 34 which is aligned with the target window 20, the target material 16, the spring loaded piston 18, and the beam tube 12. The window cooling space 34 is enclosed by the vacuum window 36 which is constructed in the preferred embodiment of aluminum. The vacuum window 36 is attached to the spacer 28 at its forward most portion facing the beam tube 12 and is in alignment with, and enclosing, the window cooling space 34. The space 34 is therefore bordered at its forward most section by the vacuum window 36 and at its rearward most section by the target window 20. It will be understood that the vacuum window can be constructed of various other materials in addition to aluminum. The nose piece 26 is provided with a centrally disposed forward beam reception space 38 which is aligned with the vacuum window 36 and the beam tube 12. The nose piece 26 and the window cooling spacer 28 are used to hold and seal the vacuum window 36 and the target window 20 in place. The nose piece 26, spacer 28, and target body 24 are held firmly in place by screwing the compression nut 30 onto the coupling union 32. The nose piece 26 is provided at its front most portion with the receptor ring 40 which receives and is attached to the beam tube 12. The receptor ring 40 is provided with a vacuum seal O-ring 42 which is seated between the outer diameter of the receptor ring 40 and the inner diameter of the beam tube 12. It will be understood that the O-ring 42 is used to keep the vacuum from the vacuum tank of the cyclotron 14 from being broken out to the air.

In the preferred embodiment, the compression nut 30 can be used to clamp the target body 24 into a position of alignment with the beam tube 12 so as to provide a seal of the vacuum from the beam tube 12 to the target body 24. It will be understood, however, by those skilled in the art that attachment of the beam tube in augmentation with the compression nut 30 and/or the nose piece 26, and sealing of the vacuum created by the cyclotron 14, can be provided by other means.

Details of the window seals are shown generally at 41 in FIG. 1. The method of sealing in the preferred embodiment uses small ridges machined on both sides of the spacer 28 to apply high pressure to the target window 20 and the vacuum window 36, each of which is sandwiched between two thin gold sealing washers. It will be understood that many other different means for providing window seals may be employed.

The window cooling space 34 is provided with one or more helium jets 43 (helium source not shown) which are used to cool the windows 20 and 36 to maintain even heat balance. The space 34 is further provided with one or more gas exit vents 44 for escape of the cooling helium gas provided by the helium jet 43. It will be recognized that other means of window temperature balance, cooling, ventilation and source supply can be utilized.

The target body 24 is fitted with a recovery water inlet tube 46 and a recovery water outlet tube 48 to establish a flow of water or other suitable fluid (hereinafter "water") respectively into conduit 46 in the direction of arrow 47 through the target material 16 where a slurry is produced and then out of conduit 48 in the direction of arrow 49. The water enters conduit 46 and leaves conduit 48 after passing through the porous metal frits 22 and the chamber containing the target material 16. It will be recognized that many different means can be utilized to provide water to the target material 16 at different time intervals and volumes.

The piston 18 is provided with one or more rings 51 which provide sealing to the target material 16.

This spring loaded piston 18 is provided with a spring mechanism 50 which can be adjusted with the nut 52, which is received by the rear most portion 53 of the target body 24, to apply pressure to the target material 16 independent of the water pressure provided by water flow in the direction of arrow 47 in order to achieve optimum conditions for the production and recovery of the radioactive nitrogen-13 product. The head 19 of the piston 18 sits behind the target material 16 and is spring loaded by the spring mechanism 50 to apply the force onto the target material 16. In this connection, the target material is maintained in the chamber defined by the target body 24, the target window 20 and the piston head 19.

Means are provided for dissipating the heat generated during the production of nitrogen-13 atoms. To this end, the system 10 is provided with a cooling water inlet tube 54, a cooling water connecting tube 56, a target body cooling coil 58, and a cooling water outlet tube 60 which are connected as shown in FIG. 1. The target assembly system 10 is cooled during proton bombardment (beam 15) by water or another suitable coolant flowing into the inlet tube 54 in the direction of the arrow 55 to the piston 18, out of the connecting tube 56 (in the direction of arrow 57) leading from the piston 18, into the target body cooling coil 58 (shown by arrow 59), and then out of the cooling coil 58 through the cooling water outlet tube 60 as is shown by the direction of arrow 61. The cooling coil 58 extends around the target body 24 to dissipate the heat generated in the body 24. It will be understood that different sequences of water flow in and out of the piston 18 and the cooling coil 58 can be provided to cool the target body 24 and that different cooling components can be provided in lieu of the cooling coils 58 of the preferred embodiment.

In the preferred embodiment, therefore, the proton beam 15 passes through the vacuum window 36, the window cooling space 34 filled with flowing helium from the helium jet 43, and the target window 20, before entering the target material 16 contained in the above-mentioned chamber which is pressurized by the action of the spring loaded piston head 19. As discussed earlier, the target material 16 is contained in the chamber defined by the target window 20, the frits 22, the spring loaded piston 18, and the target body 24. The target material 16 in the preferred embodiment is enriched carbon-13 powder which is captured and maintained at high pressure and washed through by natural water flowing in the direction of arrow 47 and leaving in the direction of arrow 49 through porous metal frits 22. The frits are fine filters which allow the water to pass through, but do not allow the carbon to pass into the tubes 46 and 48. The water, therefore, essentially flows in the direction of arrow 47 and wets the carbon target material 16 and fills the remaining volume of the target chamber. The entrance pressure from the water flowing in the direction of arrow 47 forces the water to flow back out in the direction of arrow 49. The target window 20 retains the water and the carbon 13 which ends up as a mixture referred to as a slurry.

When this slurry is subjected to the proton beam, radioactive nitrogen-13 is produced concurrently, in the carbon-13 slurry 16 by the p,n reaction, and in the oxygen-16 of natural water by the p,$\alpha$ reaction. The chemical form of the nitrogen-13 removed from the target material by the one-pass water flowing in the direction of arrow 49 through the recovery water outlet tube 48 is predominantly ammonium ion in aqueous solution. The radioactive water effluent is then transported by the outlet tube 48 through the purification column of conventional design and shown generally in block 62 to remove unwanted nitrogen oxides. The resultant purified nitrogen-13 ammonium ion aqueous product is collected for use as is shown generally in block 64. In the preferred embodiment, the collection of the nitrogen-13 product can be accomplished by simple continuous flow collection, thus precluding complex chemical processing and radioactive decay losses.

Figure 2:
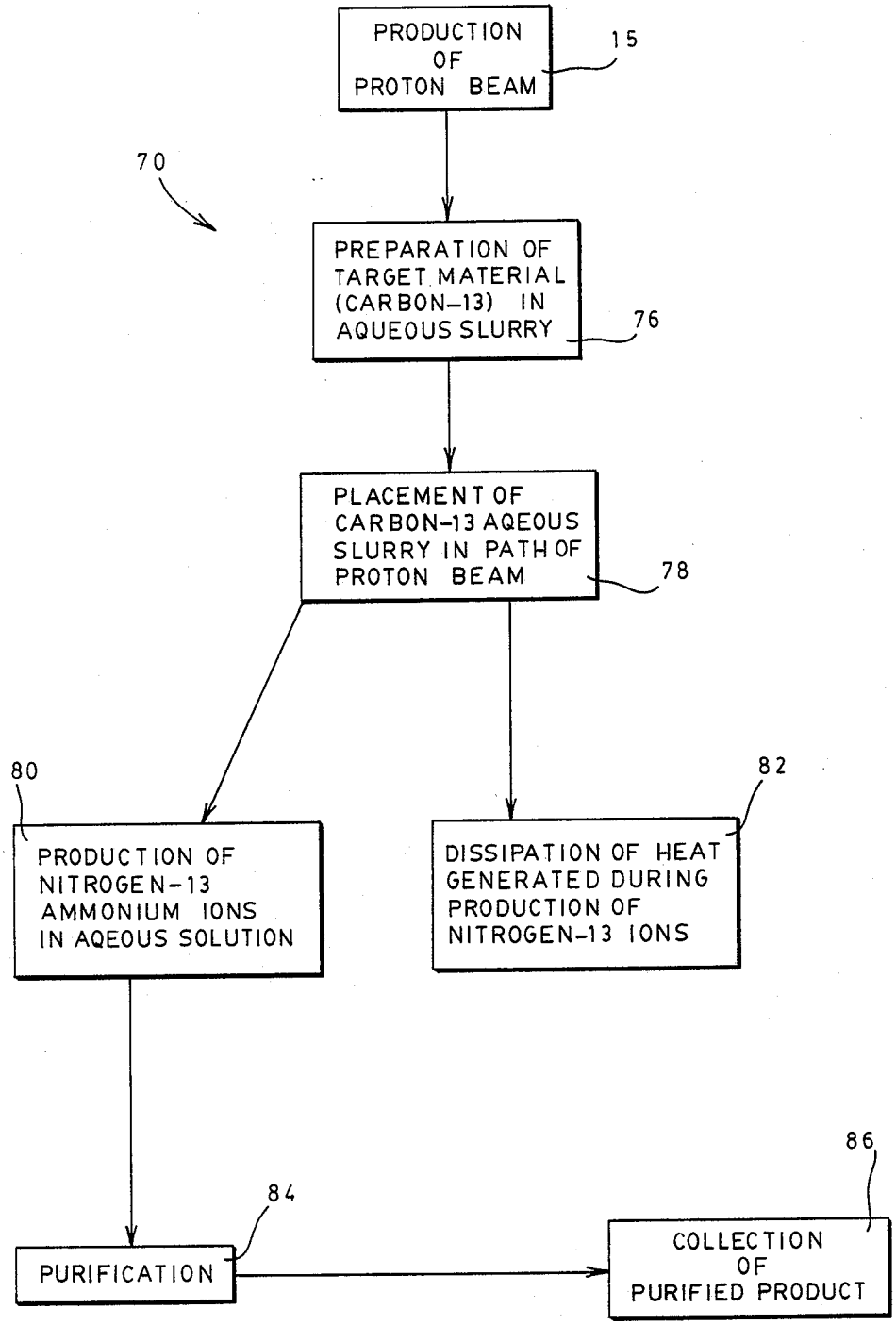
FIG. 2 is a schematic diagram of a process depicting various features of the present invention showing the general steps for utilization of the target of the present invention to produce nitrogen-13 ammonium ion in aqueous solution.

A process for the production of nitrogen-13 ammonium ion is schematically represented generally at 70 in FIG. 2. The illustrated process 70 utilizes a proton accelerator 14 as described above in connection with FIG. 1 to produce a proton beam 15. In the preferred embodiment, the proton accelerator 14 will be a cyclotron providing 11 MeV protons in a proton beam 15 collimated to a 10 mm diameter. However, it will be understood by those skilled in the art that different diameters, intensities, and energies of proton beams can be provided by different sources. The carbon-13 in the preferred embodiment is mixed with water (46, 47 in FIG. 1) to prepare the carbon-13 aqueous slurry (target material 16) as is indicated at 76 in FIG. 2. Then the slurry from the production step 76 is placed in the path of the proton beam 15 as shown generally as step 78. Nitrogen-13 ammonia ions are then produced in aqueous solution shown generally as step 80. Concurrently, it is necessary to provide means for the dissipation of heat generated during production of nitrogen-13 ions shown generally at 82. The radioactive ammonium ion in aqueous solution is then conducted through a purification column in step 84 to remove unwanted nitrogen oxides, and the resultant purified product is collected at step 86 for use. (Shown at 64 in FIG. 1).

As described above, the beam of protons 15 enters the target material in aqueous slurry 76. The protons entering the target material 76 interact with the carbon-13 atom in the p,n nuclear reaction (protons in, neutrons out) which is characteristically shown by shorthand notation as follows:

$$^{13}C(p,n)^{13}N, \quad (1)$$

where the target atom appears on the left, the reaction type is in the middle, and the product is on the right, and may also be shown by:

$$^{13}_{6}C + ^{1}_{1}H \rightarrow ^{13}_{7}N + ^{1}_{0}n, \quad (2)$$

where the

"$^{1}_{1}H$"

represents the proton and the

"$^{1}_{0}n$"

represents the neutron.

Concurrently, radioactive nitrogen-13 is produced in the natural oxygen-16 water, a part of the water slurry 76, by the p,α reaction:

$$^{16}O(p,\alpha)^{13}N \quad (3)$$

A fraction of the radioactive nitrogen-13 atoms produced in the carbon-13/fluid target material 76 recoils and diffuses into the water:

$$^{13}N \rightarrow ^{13}NH_4^+ \quad (4)$$

The nitrogen-13 radioactive atom traveling in the water slows down, stops, ionizes, and picks up hydrogen to form the ammonium ion.

In the reaction shown in formula (4) above, the majority of the $^{13}N$ product is in the form of the ammonium ion, and the balance is produced in two forms of nitrogen oxides: (1) nitrate ($^{13}NO_3^-$) and (2) nitrite ($^{13}NO_2^-$). These nitrogen oxides are easily removed by running the aqueous solution products through an ion exchange column (purification step 84 in FIG. 2) to obtain the purified nitrogen-13 ammonium ion product for collection 86.

It will be understood that many different types of reactions can occur to produce different nitrogen-13 products by the utilization of different target materials and different fluids in lieu of water to make up the target slurry 76.

We claim:

1. A sytem for the production of nitrogen-13 atoms, said system including:

means for producing a proton beam which travels along a preselected path;

target means containing a slurry target material of powdered carbon-13 in a liquid, said target means being positioned in said path of said proton beam whereby subjection of said target material to said proton beam produces nitrogen-13 atoms in a desired chemical form;

means for dissipating heat generated during said production of said nitrogen-13 atoms;

means for retaining said powdered carbon-13 in said target means;

means for separation of said nitrogen-13 atoms in said chemical form for collection of desired purified product containing said nitrogen-13 atoms; and means for transporting said nitrogen-13 atoms in said chemical form from said target means to said means for separation of said desired purified product containing nitrogen-13 atoms.

2. The system of claim 1 wherein said means for producing said proton beam along a preselected path comprises a cyclotron.

3. The system of claim 1 wherein said liquid is natural water and subjection of said target material to said proton beam produces nitrogen-13 ammonium ions in aqueous solution.

4. The system of claim 1 wherein said target means positioned in path of said proton beam is a target material constituting carbon-13 powder and water in aqueous slurry whereby said subjection of said target material to said proton beam produces nitrogen-13 ammonium ion in aqueous solution.

5. The system of claim 3 wherein said means for dissipating heat generated during production of said nitrogen-13 ammonium ions comprises a cooling water supply and a circulating system for cooling said target means.

6. The system of claim 3 wherein said means for transporting said nitrogen-13 ammonium ions in aqueous solution from said location of said target means comprises:

a delivery water inlet tube for supplying an inflow of water from a water source to said target material;

a recovery water outlet tube, providing an outflow of water from said target material, whereby said nitrogen-13 ammonium ions are transported from said target material to said means for separation; and frit means for preventing said powdered carbon-13 from passing into said inlet tube and said outlet tube.

7. A system for the production of nitrogen-13 ammonium ions, said system including:

means for producing a proton beam which travels along a preselected path, said means for producing said proton beam comprising a cyclotron;

target means containing a slurry target material, said target means being positioned in said path of said proton beam whereby subjection of said target material to said proton beam produces nitrogen-13 ammonium ions in an aqueous solution, said target material constituting an aqueous slurry of carbon-13 powder and water, means for retaining said carbon-13 powder in said target means;

means for dissipating heat generated during said production of said nitrogen-13 ammonium ions;

means for separating said nitrogen-13 ammonium ions for collection of purified product containing nitrogen-13 ammonium ions; and means for transporting said nitrogen-13 ammonium ions in said aqueous solution from said target means to said means for separation of said nitrogen-13 ammonium ions.

8. The system of claim 7 wherein said means for dissipating heat generated during production of said nitrogen-13 ammonium ions comprises a cooling water supply and a circulating system for removing heat from said target means.

9. The system of claim 7 wherein said means for transporting said nitrogen-13 ammonium ions in aqueous solution from said location of said target means comprises:

a delivery water inlet tube for supplying an inflow of water from a water source to said target material;

a recovery water outlet tube for providing an outflow of water from said target material, whereby said nitrogen-13 ammonium ions are transported from said target material to said means for separation; and frit means for preventing said carbon-13 powder from passing into said inlet tube and said outlet tube.

10. A process for the production of nitrogen-13 ammonium ions in an aqueous solution, which comprises:

positioning a target material within a target holder, said target material consisting essentially of a slurry of carbon-13 particles in water, said water containing oxygen-16;

irradiating said target material within said target holder with a beam of protons to produce nitrogen-13 atoms by a reaction of said protons with said carbon-13 and with said oxygen-16;

removing heat from said target holder during said irradiation of said target material with said protons;

passing water through said target material, without removing said carbon particles, to remove said nitrogen-13 atoms from said target material as nitrogen-13 ammonium ions and nitrogen-13 oxides in said water passing through said target material; and collecting said nitrogen-13 ammonium ions contained in said aqueous solution.

11. The process of claim 10 further comprising separating said nitrogen-13 oxides from said nitrogen-13 ammonium ions after removing said nitrogen-13 atoms from said target material and prior to said collecting of said nitrogen-13 ammonium ions.

12. The process of claim 10 further comprising maintaining a pressure upon said target material during said irradiation and during said passing of water through said target material to maintain a dense slurry and thereby enhance efficiency of said irradiation of said slurry by said protons.

13. A process for the production of nitrogen-13 ammonium ions in an aqueous solution, which comprises:

positioning a target material in a target holder, said target material consisting essentially of a water slurry of carbon particles, said carbon particles enriched in an isotope of carbon selected from carbon-12 and carbon-13;

irradiating said target material within said target holder with a beam of energetic particles selected from deuterons for a slurry of carbon-12 and protons for a slurry of carbon-13 to product nitrogen-13 atoms through the reaction of deuterons with carbon-12 and protons with carbon-13, respectively;

removing heat from said transfer holder during said irradiation of said target material with said energetic particles;

passing water through said target material, without removing said carbon particles, to remove said nitrogen-13 atoms from said target material as nitrogen-13 ammonium ions and nitrogen-13 oxides in an aqueous solution;

separating said nitrogen-13 ammonium ions from said nitrogen-13 oxides; and collecting said nitrogen-13 ammonium ions.

* * * * *